US005616271A

United States Patent [19]

Podgurski

[11] Patent Number: 5,616,271

[45] Date of Patent: Apr. 1, 1997

[54] CONCRETE FORMING CHAMFER STRIP

[75] Inventor: Charles V. Podgurski, New Braunfels, Tex.

[73] Assignee: Symons Corporation, Des Plaines, Ill.

[21] Appl. No.: 654,722

[22] Filed: May 29, 1996

Related U.S. Application Data

[63] Continuation of Ser. No. 271,059, Jul. 5, 1994, abandoned.

[51] Int. Cl.[6] ..... B28B 7/00; E04G 13/02

[52] U.S. Cl. ..... 249/48; 249/159; 249/193; 249/194; 249/219.1

[58] Field of Search ..... 249/47, 48, 51, 249/159, 188, 192, 193, 194, 219.1

[56] References Cited

U.S. PATENT DOCUMENTS

| | | | |
|---|---|---|---|
| 1,295,310 | 2/1919 | Hartman | 249/188 |
| 2,985,938 | 5/1961 | Rappas | 249/188 |
| 3,782,680 | 1/1974 | Hopkins | 249/188 |
| 4,978,099 | 12/1990 | Carlson | 249/193 |

FOREIGN PATENT DOCUMENTS

| | | | |
|---|---|---|---|
| 2260334 | 6/1974 | Germany | 249/188 |
| 2348117 | 4/1975 | Germany | 249/188 |

*Primary Examiner*—Jay H. Woo
*Assistant Examiner*—Joseph Leyson
*Attorney, Agent, or Firm*—Marshall, O'Toole, Gerstein, Murray & Borun

[57] ABSTRACT

In order to form a chamfer on an outside corner of a poured concrete structure, a concrete forming system includes a first form panel having an inwardly facing surface and second form panel also having an inwardly facing surface. The first form panel is secured to the second form panel with the inwardly facing surfaces at an angle to one another and the inwardly facing surfaces of the form panels have adjacent side edges for forming an outside corner. A chamfer strip including a body portion and a tail portion is provided for forming a chamfer on the outside corner. The body portion is substantially hollow and has three sides arranged so as to be generally triangular in shape and the tail portion comprises an elongated continuation of one of the sides of the body portion. With this understanding of the concrete forming system, the chamfer strip is formed in such a manner as to permit flexing of the chamfer strip so as to create a seal with the form panels during the pouring of concrete.

16 Claims, 1 Drawing Sheet

CONCRETE FORMING CHAMFER STRIP

This is a Rule 62 file wrapper continuation of U.S. application Ser. No. 08/271,059, filed Jul. 5, 1994, now abandoned.

FIELD OF THE INVENTION

The present invention is generally directed to concrete forming systems and, more particularly, a concrete forming system that incorporates a flexible chamfer strip.

BACKGROUND OF THE INVENTION

Generally speaking, it is known that there are a variety of systems available for the forming of concrete. The concrete may be formed, by way of example, to create walls, bridge piers, square or rectangular columns, interior corners, and tops of walls and parapets. Conventionally, the intersection of any two surfaces of concrete in any structure has been in the form of a line.

In other words, the two surfaces of concrete are designed to intersect at an angle. The intersection typically comprises a line of intersection, i.e., the line defined by the intersection of the planes in which the two surfaces lie. However, in many applications, it is desirable to be able to avoid the "sharpness" of a line of intersection.

More specifically, it is desirable in applications of various types to replace the typical line of intersection with a chamfer. This chamfer is ideally formed during the pouring of concrete, i.e., the concrete forming system itself is such as to form the chamfer. For this purpose, there are certain requirements that must be met in order for the chamfer forming to be entirely successful.

More specifically, the chamfer should be capable of being formed with a strip that is reusable and lightweight, yet durable and rigid, while at the same time having flexible or "plastic" characteristics. Still additionally, the chamfer strip should be capable of use with conventional steel or wood forms and capable of being secured along a form joint or sandwiched between interior and exterior form joints.

The present invention is directed to overcoming one or more of the foregoing problems and achieving one or more of the resulting objects.

SUMMARY OF THE INVENTION

It is therefore a principal object of the present invention to provide a unique improvement in concrete forming systems and the like. It is a further object of the present invention to provide a chamfer strip for forming a chamfer on a corner. It is an additional object of the present invention to provide a chamfer strip that permits flexing to create a seal with form panels.

Accordingly, the present invention is directed to a concrete forming system having a first form panel with an inwardly facing surface and a second form panel also having an inwardly facing surface together with means for securing the first form panel to the second form panel with the inwardly facing surfaces at an angle. The inwardly facing surfaces of the form panels have adjacent side edges for forming a corner. A chamfer strip including a body portion and a tail portion is provided for forming a chamfer on the formed corner wherein the body portion is formed to be substantially hollow and to have three sides arranged so as to be generally triangular in shape and the tail portion comprises an elongated continuation of one of the side portions. The concrete forming system also includes means associated with the chamfer strip to permit flexing of the chamfer strip to create a seal with the form panels. In a preferred embodiment of the invention, the flexing means includes forming the chamfer strip of a plastic material so as to be at an angle of slightly greater than 90° to be positioned in a right angle corner defined by the inwardly facing surfaces of the form panels.

In the exemplary embodiment, the chamfer strip has means internally of the hollow body portion for reinforcement thereof which may advantageously take the form of a reinforcing rib. In this connection, the body portion of the chamfer strip is preferably an isosceles right triangle having first and second legs of equal length and a hypotenuse. With this arrangement, the reinforcing rib preferably extends from the point of intersection of the first and second legs to the hypotenuse so as to be at a right angle thereto.

In a highly preferred embodiment, the tail portion of the chamfer strip is substantially longer than any of the three sides of the body portion thereof. It is still more specifically the case that the tail portion of the chamfer strip is advantageously an elongated continuation of one of the first and second legs of the right triangle body portion. In a most highly preferred embodiment, the tail portion of the chamfer strip is on the order of three times longer than the first and second legs thereof.

Also, in a most highly preferred embodiment, the plastic material of the chamfer strip is formed of a polyvinyl chloride extrusion made from virgin material. It is also highly advantageous for the first and second chamfer strip legs to have outwardly facing surfaces which can be disposed in contact with the inwardly facing surfaces of the form panels to thereby create the seal with the form panels. In order to achieve this objective, the first and second legs of the chamfer strip are preferably disposed at angle of between approximately 92° and 93°.

Other objects, advantages and details of the present invention will become apparent from a consideration of the following specification taken in conjunction with the accompanying drawings.

DETAILED DESCRIPTION OF THE PREFERRED EMBODIMENT

Figure 1:
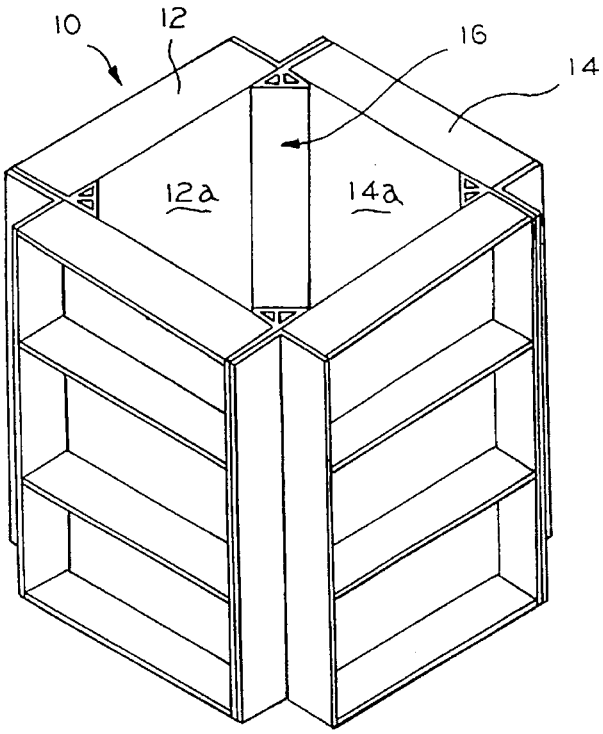
FIG. 1 is a perspective view of a concrete forming system with sealing chamfer strips in accordance with the present invention.
Figure 2:
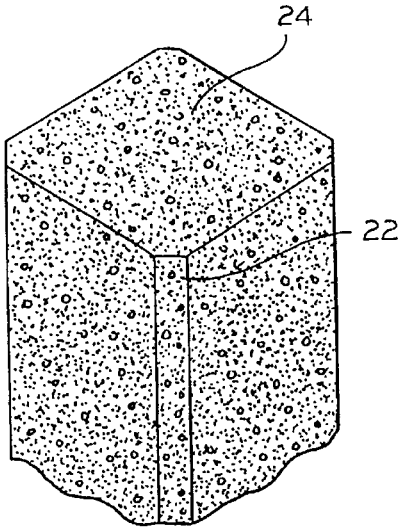
FIG. 2 is a perspective view of a column which has been formed by utilizing the concrete forming system and sealing chamfer strips of FIG. 1.

In the illustrations given, and with reference first to FIG. 1, the reference numeral 10 designates generally a concrete forming system in accordance with the present invention. The concrete forming system 10 includes a first form panel 12 having an inwardly facing surface 12*a* and a second form panel 14 also having an inwardly facing surface 14*a* together with means for securing the first form panel 12 to the second form panel 14 with the inwardly facing surfaces 12*a* and 14*a* at an angle. The inwardly facing surfaces 12*a* and 14*a* of the form panels 12 and 14 will be seen to have adjacent side edges 12*b* and 14*b* for forming a corner. A chamfer strip generally designated 16 including a body portion 18 and a tail portion 20 are provided for forming a chamfer such as 22 on a corner of a structure such as a column 24 (see FIGS. 2 and 4). The body portion 18 is formed to be substantially hollow and to have three sides 26, 28 and 30 arranged so as to be generally triangular in shape. The concrete forming system 10 also contemplates the chamfer strip 16 having the tail portion 20 formed as what may best be described as an elongated continuation of one of the side portions such as 26, i.e., the tail portion 20 and the side portion 26 are two portions of a single, continuous wall. With this arrangement, the concrete forming system 10 also contemplates means associated with the chamfer strip 16 to permit flexing of the chamfer strip 16 to create a seal with the form panels 12 and 14.

More specifically, the flexing means derives from the geometry of the chamfer strip 16 and the fact that it is formed of a plastic material at angle slightly greater than 90°. It is believed to be highly advantageous in this connection for the first and second legs 26 and 28 of the chamfer strip 16 to be disposed at an angle of approximately 92° to 93°. By also forming the chamfer strip 16 of a plastic material, it has been found that the chamfer strip 16 is thereby capable of flexing to create a seal with the form panels 12 and 14.

Referring once again to FIG. 4, it will be seen and appreciated that the tail portion 20 of the chamfer strip 16 is of substantially greater length than any of the three sides 26, 28 and 30 of the body portion 18 of the chamfer strip 16. It is also highly advantageous for the body portion 18 of the chamfer strip to be formed as an isosceles right triangle in which case the first and second legs 26 and 28 are of equal length and the third leg 30 forms the hypotenuse. As a result, the tail portion 20 of the chamfer strip 16 comprises an elongated continuation of one of the first and second legs such as 26 of the right triangle, preferably on the order of three times longer than the first and second legs 26 and 28 of the chamfer strip 16.

In addition to the foregoing (see FIG. 4), the flexing means preferably also includes the chamfer strip 16 having means internally of the hollow body portion 18 for reinforcement thereof. It is advantageous in this connection for the reinforcement to comprise a reinforcing rib 32 extending generally from the point of intersection of the first and second legs 26 and 28 to the hypotenuse 30 at a right angle thereto. With this arrangement, the plastic chamfer strip 16 is thereby able to flex in order to create the seal without distorting under the pressure that is present when concrete is poured.

In a highly preferred embodiment, the plastic material of the chamfer strip 16 is formed of a polyvinyl chloride extrusion made from virgin material. This material is extruded in the unique particular shape that has been defined hereinabove. With this unique particular shape of the chamfer strip 16, it can be used with modular and job-built concrete forming systems such as 10.

Figure 3:
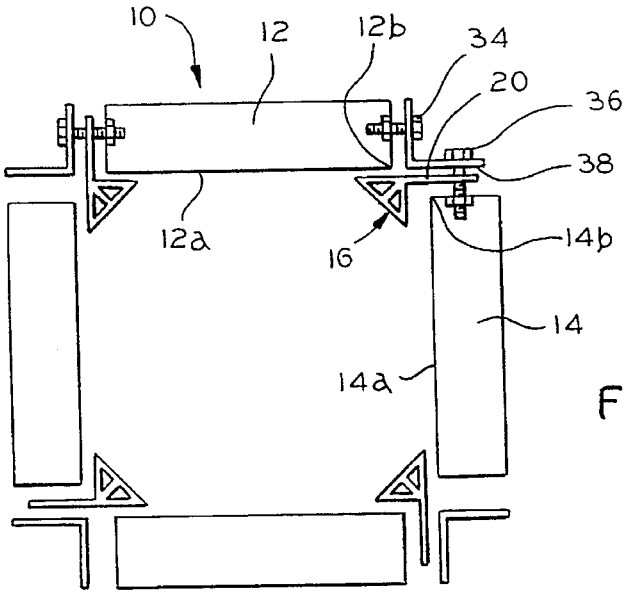
FIG. 3 is a top plan view of the concrete forming system of FIG. 1 showing the assembly of the components for a concrete pouring operation.
Figure 4:
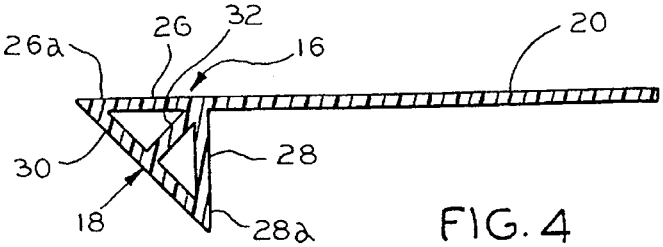
FIG. 4 is a cross-sectional view of a sealing chamfer strip for a concrete forming system of the type which has been illustrated in FIG. 1.

As will be appreciated by comparing FIGS. 1, 3 and 4, the first and second chamfer strip legs 26 and 28 have outwardly facing surfaces 26*a* and 28*a* which are adapted to be disposed in contact with the inwardly facing form panel surfaces 12*a* and 14*a*. Still more specifically, the chamfer strip 16 flexes during a concrete pour after the first form panel 12 has been secured to the second form panel 14 as by means of the bolts 34 and 36 in cooperation with the angle 38 so as to create the seal.

In other words, the bolts 34 and 36 in cooperation with the angle 38 draw the side edges 12*b* and 14*b* closely together and poured concrete forces the surfaces 26*a* and 28*a* into tightly abutting contact with the surfaces 12*a* and 14*a* by flexing the chamfer strip 16 to thereby create a seal with the form panels 12 and 14.

With the present invention, the concrete forming system is fully capable of forming chamfers at outside corners of walls, bridge piers, square or rectangular columns, interior corners, and tops of walls and parapets. The elongated tail portion 20 is designed to allow the chamfer strip 16 to be bolted along a form joint or sandwiched between interior or exterior form joints with one example being clearly illustrated in FIG. 3. As will also be appreciated, the tail portion 20 in conjunction with the plastic nature of the material allows it to be cut and nailed in the case of wood forming applications.

In a most highly preferred embodiment, the chamfer strips 16 can be utilized to form ¾ inch and 1 inch chamfers, i.e., the length of the legs 26 and 28 can be ¾ inch or 1 inch. It is then advantageous for the tail portion 20, in either case, to be approximately 3 inches in length with the entirety of the chamfer strip 16 having thicknesses of approximately 0.100 inch. Of course, the invention is not limited to any specific dimensions since the dimensions will depend upon the particular application that is being satisfied.

While in the foregoing there has been set forth a preferred embodiment of the invention, it will be appreciated that the details herein given may be varied by those skilled in the art without departing from the true spirit and scope of the appended claims.

I claim:

1. A concrete forming system, comprising:

a first form panel having an inwardly facing surface and a second form panel having an inwardly facing surface;

means for securing said first form panel to said second form panel with said inwardly facing surfaces at an angle;

said inwardly facing surfaces of said form panels having adjacent side edges for forming an outside corner; and a chamfer strip for forming a chamfer on said outside corner including a body portion and a tail portion, said body portion being hollow and having three continuous sides arranged so as to form a closed, generally triangular shape with two of said three continuous sides each respectively contacting one of said inwardly facing surfaces and said tail portion comprising an elongated continuation of one of said contacting continuous sides wherein said tail portion extends between said adjacent side edges, means to permit flexing of said chamfer strip to create a seal with said form panels, and means internally of said closed, generally triangular shape defined by said three continuous sides of said hollow body portion of said chamfer strip for reinforcement thereof.

2. The concrete forming system of claim 1 wherein said flexing means includes said chamfer strip being formed of a polyvinyl chloride extrusion made from virgin material.

3. The concrete forming system of claim 1 wherein said tail portion of said chamfer strip is substantially longer than any of said three sides of said body portion of said chamfer strip.

4. The concrete forming system of claim 1 wherein said body portion of said chamfer strip is an isosceles right triangle having first and second legs of equal length and a hypotenuse, said first and second legs defining said two contacting sides.

5. The concrete forming system of claim 4 wherein said reinforcement means includes a reinforcing rib extending from the point of intersection of said first and second legs to said hypotenuse at a right angle thereto.

6. A concrete forming system, comprising:

a first form panel having an inwardly facing surface and a second form panel having an inwardly facing surface;

means for securing said first form panel to said second form panel with said inwardly facing surfaces at an angle;

said inwardly facing surfaces of said form panels having adjacent side edges for forming an outside corner; and a chamfer strip for forming a chamfer on said outside corner including a body portion and a tail portion, said body portion being hollow and having three continuous sides arranged so as to form a closed, generally triangular shape with two of said three continuous sides each respectively contacting one of said inwardly facing surfaces and said tail portion comprising an elongated continuation of one of said contacting continuous sides wherein said tail portion extends between said adjacent side edges, and means to permit flexing of said chamfer strip to create a seal with said form panels;

said flexing means including said chamfer strip being formed of a plastic material at an angle slightly greater than 90 degrees, said angle being between the two contacting continuous sides of the closed, generally triangular shape, and means internally of said closed, generally triangular shape defined by said three continuous sides of said hollow body portion of said chamfer strip for reinforcement thereof.

7. The concrete forming system of claim 6 wherein said plastic material of said chamfer strip is formed of a polyvinyl chloride extrusion made from virgin material.

8. The concrete forming system of claim 6 wherein said tail portion of said chamfer strip is substantially longer than any of said three sides of said body portion of said chamfer strip.

9. The concrete forming system of claim 6 wherein said body portion of said chamfer strip is substantially in the form of an isosceles right triangle having first and second legs of equal length and a hypotenuse, said first and second legs defining said two contacting sides.

10. The concrete forming system of claim 9 wherein said reinforcement means includes a reinforcing rib extending from the point of intersection of said first and second legs to said hypotenuse at a right angle thereto.

11. A concrete forming system, comprising:

a first form panel having an inwardly facing surface and a second form panel having an inwardly facing surface;

means for securing said first form panel to said second form panel with said inwardly facing surfaces at an angle;

said inwardly facing surfaces of said form panels having adjacent side edges for forming an outside corner; and a chamfer strip for forming a chamfer on said outside corner including a body portion and a tail portion, said body portion being substantially hollow and having three continuous sides arranged so as to form a closed, generally triangular shape with two of said three continuous sides each respectively contacting one of said inwardly facing surfaces and said tail portion comprising an elongated continuation of one of said contacting continuous sides wherein said tail portion extends between said adjacent side edges and means to permit flexing of said chamfer strip to create a seal with said form panels;

said tail portion of said chamfer strip being substantially longer than any of said three continuous sides of said body portion of said chamfer strip, said body portion of said chamfer strip being substantially in the form of an isosceles right triangle having first and second legs of equal length and a hypotenuse, said first and second chamfer strip legs having outwardly facing surfaces to be disposed in contact with said inwardly facing form panel surfaces;

said flexing means including said chamfer strip being formed of a plastic material at an angle slightly greater than 90 degrees, said angle being between the two contacting continuous sides of the closed, generally triangular shape, and means internally of said closed, generally triangular shape defined by said three continuous sides of said hollow body portion of said chamfer strip for reinforcement thereof.

12. The concrete forming system of claim 11 wherein said plastic material of said chamfer strip is formed of a polyvinyl chloride extrusion made from virgin material.

13. The concrete forming system of claim 11 wherein said reinforcement means includes a rib extending from the intersection of said first and second legs to said hypotenuse at a right angle thereto.

14. The concrete forming system of claim 11 wherein said first and second legs of said chamfer strip are disposed at an angle of approximately 92 to 93 degrees.

15. The concrete forming system of claim 11 wherein said tail portion of said chamfer strip is on the order of three times longer than said first and second legs of said chamfer strip.

16. A chamfer strip for forming a chamfer on an outside corner of a poured concrete structure in conjunction with a pair of form panels of a concrete forming system, comprising:

a substantially hollow body portion having a tail portion and three continuous sides arranged so as to form a closed, generally triangular shape with two of said three continuous sides each respectively being adapted to contact an inwardly facing surface of one of said form panels, said tail portion comprising an elongated continuation of one of said contacting continuous sides wherein said tail portion is adapted to extend between adjacent side edges of said form panels, means to permit flexing of said chamfer strip to create a seal with said form panels, and means internally of said closed, generally triangular shape defined by said three continuous sides of said hollow body portion of said chamfer strip for reinforcement thereof.

* * * * *